US011725458B2

(12) United States Patent
Alzaki et al.

(10) Patent No.: US 11,725,458 B2
(45) Date of Patent: Aug. 15, 2023

(54) CUTTING A SIDETRACK WINDOW

(71) Applicant: Saudi Arabian Oil Company, Dhahran (SA)

(72) Inventors: Hussien A. Alzaki, Saihat (SA); Mohammad K. Aljishi, Alqatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/492,262

(22) Filed: Oct. 1, 2021

(65) Prior Publication Data

US 2023/0105473 A1 Apr. 6, 2023

(51) Int. Cl.

| | |
|---|---|
| ***E21B 29/06*** | (2006.01) |
| ***E21B 7/04*** | (2006.01) |
| ***E21B 7/06*** | (2006.01) |

(52) U.S. Cl.

CPC ..... *E21B 7/046* (2013.01); *E21B 7/061* (2013.01); *E21B 29/06* (2013.01)

(58) Field of Classification Search

CPC ..... E21B 7/046; E21B 7/041; E21B 29/06
See application file for complete search history.

(56) References Cited

U.S. PATENT DOCUMENTS

| | | | | |
|---|---|---|---|---|
| 5,222,554 | A * | 6/1993 | Blount | E21B 23/01 166/117.6 |
| 5,791,417 | A * | 8/1998 | Haugen | E21B 43/114 166/298 |
| 6,012,526 | A * | 1/2000 | Jennings | E21B 41/0035 166/55.7 |
| 7,306,056 | B2 | 12/2007 | Ballantyne et al. | |
| 8,430,187 | B2 | 4/2013 | Hearn | |
| 9,938,781 | B2 | 4/2018 | Bansal et al. | |
| 10,883,359 | B2 * | 1/2021 | Stokes | E21B 33/134 |
| 2002/0170713 | A1 | 11/2002 | Haugen et al. | |

(Continued)

FOREIGN PATENT DOCUMENTS

| | | |
|---|---|---|
| GB | 2316424 | 2/1998 |
| WO | WO 83/03457 | 10/1983 |
| WO | WO 2012161910 | 11/2012 |

OTHER PUBLICATIONS

PCT International Search Report and Written Opinion in International Appln. No. PCT/US2022/077357, dated Dec. 23, 2022, 15 pages.

*Primary Examiner* — Taras P Bemko
(74) *Attorney, Agent, or Firm* — Fish & Richardson P.C.

(57) ABSTRACT

A sidetracking method includes lowering a sidetrack assembly to a target zone of a wellbore comprising a casing. The sidetrack assembly comprising a cutting tool coupled to a wellbore string and a whipstock releasably coupled to the cutting tool. The method includes setting the whipstock on a wall of the wellbore, pulling the wellbore string, decoupling the cutting tool from the whipstock, actuating the cutter, cutting along a cut profile of the casing to cut free a portion of the casing at the target zone, actuating the mechanical fasteners, fastening the portion of the casing to the cutting tool, pulling the wellbore string, detaching the portion of the casing from the wall of the wellbore, drilling, with a directional drill string a sidetrack wellbore extending from the window to a downhole location of the sidetrack wellbore, and removing the whipstock from the wellbore.

19 Claims, 10 Drawing Sheets

(56) References Cited

U.S. PATENT DOCUMENTS

| | | | | |
|---|---|---|---|---|
| 2003/0098152 | A1* | 5/2003 | Kennedy | E21B 7/061 175/81 |
| 2005/0150692 | A1* | 7/2005 | Ballantyne | E21B 41/0035 166/50 |
| 2014/0090846 | A1* | 4/2014 | Deutch | E21B 33/13 166/376 |
| 2015/0144340 | A1* | 5/2015 | Surjaatmadja | E21B 29/005 166/55 |
| 2017/0241238 | A1* | 8/2017 | Bacsik | E21B 43/14 |
| 2018/0073335 | A1* | 3/2018 | Patel | E21B 34/10 |
| 2022/0074279 | A1* | 3/2022 | Hansen | E21B 23/01 |

* cited by examiner

CUTTING A SIDETRACK WINDOW

FIELD OF THE DISCLOSURE

This disclosure relates to drilling wellbores, and more particularly to drilling sidetrack wellbores.

BACKGROUND OF THE DISCLOSURE

A sidetrack wellbore is a secondary, deviated wellbore that extends from the main wellbore. Sidetrack wellbores can be used, for example, to extract hydrocarbons from an alternate subterranean zone or formation, or to remedy a problem existing in the main wellbore. To drill a sidetrack wellbore, a whipstock can be used to deflect a drill bit from the main wellbore. The whipstock allows the drill bit to drill a sidetrack wellbore in a desired direction and location with respect to the main wellbore. Methods and equipment to improve the process of drilling a sidetrack wellbore are sought.

SUMMARY

Implementations of the present disclosure include a sidetracking method that includes lowering a sidetrack assembly to a target zone of a wellbore including a casing. The sidetrack assembly includes a cutting tool coupled to a downhole end of a wellbore string and a whipstock releasably coupled to a downhole end of the cutting tool. The cutting tool includes a movable cutter and movable mechanical fasteners. The method also includes setting the whipstock on a wall of the wellbore, fluidly isolating the target zone from a section of the wellbore downhole of the whipstock. The method also includes pulling, in an uphole direction, the wellbore string, decoupling the cutting tool from the whipstock. The method also includes actuating the cutter, cutting along a cut profile of the casing to cut free a portion of the casing at the target zone. The method also includes actuating the mechanical fasteners, fastening the portion of the casing to the cutting tool. The method also include pulling, in an uphole direction, the wellbore string, detaching the portion of the casing from the wall of the wellbore and forming a window in the casing. The method also includes drilling, with a directional drill string guided by the whipstock, a sidetrack wellbore extending from the window to a downhole location of the sidetrack wellbore. The method also includes removing, by the wellbore string or a second wellbore string, the whipstock from the wellbore. In some implementations, the cutter is operatively coupled to a controller, and actuating the cutting tool includes actuating, by the controller, the cutter to move the cutter along a cut profile of the casing at the target zone.

In some implementations, the cutting tool includes one or more arms configured to extend from a body of the cutting tool to the wall of the wellbore. The method also includes, before actuating the cutter, actuating the one or more arms to extend the arms from the cutting tool and position the cutting tool at a desired location with respect to a central longitudinal axis of the wellbore.

In some implementations, fluidly isolating the target zone from the downhole location of the wellbore includes actuating, by pressure pulses through the wellbore string, a packer of the whipstock.

In some implementations, the packer is a pull-to-release inflatable packer and removing the whipstock from the wellbore includes latching, with the cutting tool, a latch profile of the whipstock and pulling the whipstock uphole, unsetting the pull-to-release inflatable packer from the wall of the wellbore.

In some implementations, the whipstock includes hooks or anchors configured to engage the wall of the wellbore, and setting the whipstock on the wall of the wellbore includes actuating, by pressure pulses, the hooks or anchors, setting the whipstock on the wall of the wellbore.

In some implementations, the whipstock is releasably coupled to the cutting tool by at least one retractable key profile activable by pressure pulses. The method also includes, before pulling the wellbore string to decouple the cutting tool from the whipstock, activating, by pressure pulses, the key profile, retracting the key profile and disengaging the cutting tool from the whipstock.

In some implementations, the cutting tool includes an electric motor configured to move the cutter and the mechanical fasteners. The cutting tool includes a turbine coupled to a power generator. The turbine is in fluid communication with the wellbore string and configured to rotate under fluidic pressure. The power generator is configured to transmit, to the electric motor or to a battery pack configured to power the electric motor, electricity generated by rotation of the turbine to power the motor.

In some implementations, the sidetrack assembly further includes a jar assembly. The method also includes, before pulling the wellbore string to detach the portion of the casing from the wall of the wellbore, actuating, by pressure pulses, the jar assembly to loosen or remove the portion of the casing from cement retaining the portion of the casing to the wall of the wellbore.

In some implementations, cutting the portion of the casing includes circulating, in the wellbore, drilling fluid, cooling the cutting tool.

In some implementations, the sidetrack assembly includes a bottom hole assembly (BHA) fluidly coupled to the wellbore string.

Implementations of the present disclosure includes a method that includes positioning a cutting tool at a target zone of a wellbore including a casing. The cutting tool is coupled to a downhole end of the wellbore string extending from a terranean surface of the wellbore. The cutting tool includes mechanical fasteners movable by the cutting tool. The method also includes actuating the cutting tool, cutting free a portion of the casing at the target zone. The method also includes actuating the mechanical fasteners, fastening the portion of the casing to the cutting tool. The method also include pulling the wellbore string uphole, removing the portion of the casing from the casing and forming a window in the casing. The method also includes drilling, with a directional drill string, a sidetrack wellbore extending from the window to a downhole location of the sidetrack wellbore.

In some implementations, the cutting tool is operatively coupled to a controller, and actuating the cutting tool includes actuating, by the controller, an arm attached to a rotatable blade of the cutting tool to move the blade along a cut profile of the casing at the target zone.

In some implementations, the cutting tool includes an electric motor operatively coupled to the rotatable blade and to the mechanical fasteners, and actuating the cutting tool includes actuating, by the controller, the electric motor to move the blade along a cut profile. Actuating the mechanical fasteners includes actuating, by the controller, the electric motor to screw the mechanical fasteners into the portion of the casing.

In some implementations, the sidetrack assembly further includes a jar assembly. The method also includes, before pulling the wellbore string to remove the portion of the casing from the casing, actuating, by pressure pulses, the jar assembly to loosen or remove the portion of the casing from cement retaining the portion of the casing to the wall of the wellbore.

Implementations of the present disclosure also includes a wellbore assembly that includes a wellbore string configured to be disposed within a wellbore including a casing. The wellbore assembly also includes a sidetrack assembly fluidly coupled to the wellbore string. The sidetrack assembly includes a cutting tool coupled to a downhole end of a wellbore string. The cutting tool includes a movable cutter and movable mechanical fasteners. The cutting tool is configured to move the movable cutter along a cut profile of the casing to cut a portion of the casing. The cutting tool is configured to move the movable mechanical fasteners to engage the portion of the casing and remove the portion of the casing from a wall of the wellbore and form a window. The sidetrack assembly also includes a whipstock releasably coupled to a downhole end of the cutting tool. The whipstock assembly includes at least one packer configured to fluidly isolate the cutting tool from a section of the wellbore downhole of the whipstock.

In some implementations, the whipstock is configured to be set downhole of the portion of the casing and includes a wedge to guide, with the whipstock set on a wall of the wellbore, a drill string toward the window such that the dill string drills a sidetrack wellbore extending from the window to a downhole location of the sidetrack wellbore.

In some implementations, the cutter includes a rotatable blade coupled to an arm movable by a controller operatively coupled to the arm, the controller configured to move the arm to move the blade along the cut profile of the casing.

In some implementations, the packer is a pull-to-release packer, and the pull-to-release packer is activable by pressure pulses.

In some implementations, the cutting tool further includes one or more arms configured to extend from a body of the cutting tool, contacting the wall of the wellbore to center the cutting tool or position the cutting tool at a desired location with respect to a central longitudinal axis of the wellbore.

DETAILED DESCRIPTION OF THE DISCLOSURE

The present disclosure relates to a sidetrack assembly and method for cutting a sidetrack window and drilling a sidetrack wellbore. The sidetrack assembly include a cutting tool or assembly that cuts free a portion of the casing along a cut profile of the casing. The cutting assembly can also retrieve the cut piece in the same trip. The cutting assembly can be operated hydraulically such as by pressure pulses or with a controller or both.

Particular implementations of the subject matter described in this specification can be implemented so as to realize one or more of the following advantages. For example, the sidetrack assembly of the present disclosure can save time and resources by making a sidetracking window and removing the cut piece in one trip. Additionally, the whipstock of the sidetrack assembly can be removed with the same wellbore string that sets the whipstock on the wellbore, simplifying the process of drilling a sidetrack wellbore. Additionally, cutting and removing a portion of the casing before drilling the sidetrack wellbore can reduce the durations of the milling operation, reduce damage to the mill, and increase the accuracy of the window profile and size. Additionally, the sidetrack assembly can be used with minimal or no human interaction to cut the casing and drill the sidetrack wellbore, which ca save time, as the blade can cut the circumference of the window and retrieve it in one piece rather than grinding and milling the casing. Additionally, cutting a window without milling the casing can eliminate the multi-well cleaning runs required to collect metal cuttings associated with milling operations.

Figure 1:
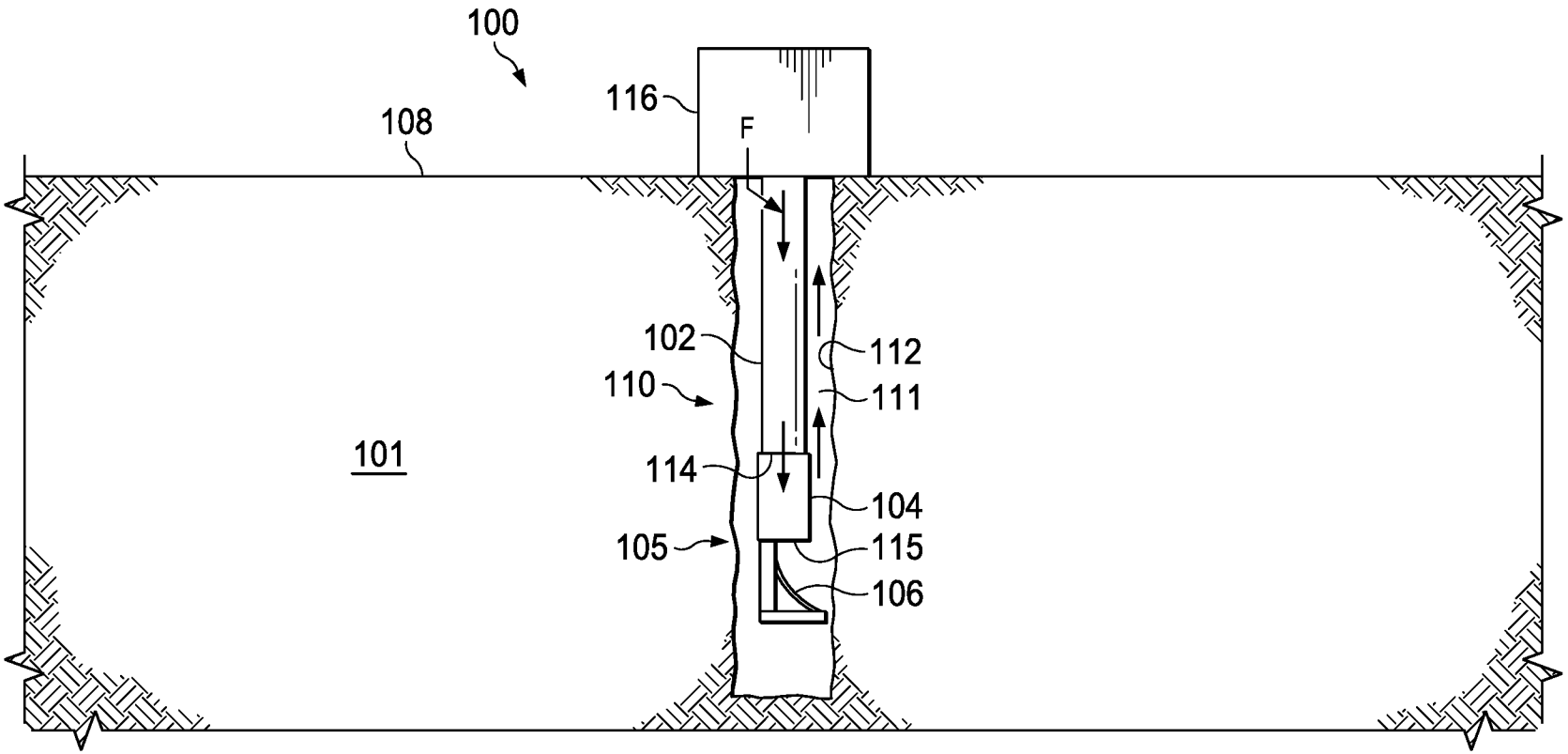
FIG. 1 is a front schematic view, partially cross sectional, of a wellbore assembly disposed in a wellbore.

FIG. 1 shows a wellbore assembly 100 disposed in a wellbore 110. The wellbore 110 can be formed in a geologic formation 101. The geologic formation 101 can include a hydrocarbon reservoir from which hydrocarbons can be extracted. The wellbore assembly 100 includes a wellbore string 102 and a sidetrack assembly 105 attached to a bottom end of the wellbore string 102. The wellbore assembly 100 can also include surface equipment 116 such as a rig to which the wellbore string 102 is attached. The surface equipment 116 resides at the terranean surface 108 of the wellbore 110.

The wellbore string 102 can be a drill string or any type of tubing assembly that can be lowered within the wellbore 110 to form an annulus 111 between the wellbore string 102 and a wall 112 of the wellbore 110. The sidetrack assembly 105 is fluidly coupled to the wellbore string 102. The wellbore string 102 flows a fluid "F" (e.g., a drilling fluid) from or near the surface 108 of the wellbore 110 to the sidetrack assembly 105. The fluid "F" can exit the sidetrack assembly 105 to flow upohole to the surface 108. For example, the wellbore string 102 is fluidly coupled to a surface pump (not shown) that flows fluid into the wellbore string 102 to flow downhole, and receives fluid that flows up the wellbore 110, through the annulus 111, to the surface 108. Thus, the wellbore assembly 100 can circulate the fluid "F" in and out of the wellbore 110.

The sidetrack assembly 105 includes a cutting tool or assembly 104 and a whipstock or whipstock assembly 106. The cutting tool 104 is attached to a downhole end 114 of a wellbore string 102. The whipstock 106 is releasably coupled to a downhole end 115 of the cutting tool 104. The whipstock 106 can be set on the wall 112 of the wellbore 110 to isolate a section of the wellbore and to guide the sidetrack drill string during the sidetrack drilling operation.

Figure 2:
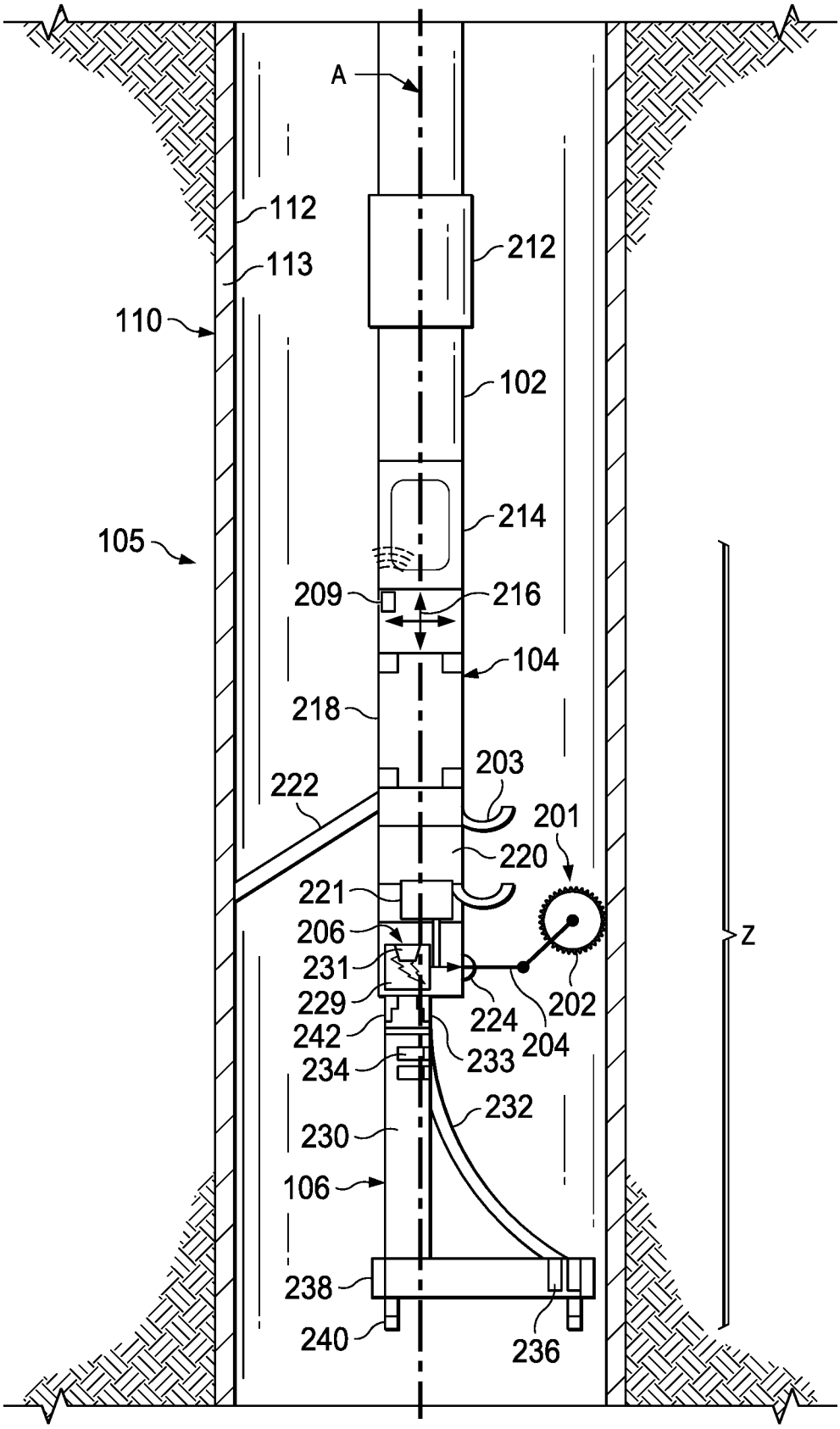
FIG. 2 is a front schematic view, partially cross sectional, of a sidetrack assembly according to implementations of the present disclosure.

As shown in FIG. 2, to cut a sidetrack window in a target zone "Z" of the wellbore 110, the sidetrack assembly can be lowered to and be set in the target zone "Z." The wellbore 110 has a casing 113 that is part of the wall 112 of the wellbore 110. For example, the wall 112 of the wellbore 110 can include the wall of the casing 113 or the cement and rock behind the casing 113 or both.

The sidetrack assembly 105 is attached (e.g., threadedly attached) to a downhole end (e.g., to a drill collar 212) of the wellbore string 102. The sidetrack assembly 105 includes the cutting tool 104 and the whipstock 106. The cutting tool 104 includes a sidewise jar 214, a processing device 216 (e.g., a computer processor with a controller), a power bank 218 (e.g., a battery pack), an electric motor 221, a housing 220, a side arm 222, mechanical fasteners 203 (e.g., hooks or screws), a power generator 229, and a cutter 201. The whipstock 106 includes a frame 230, a wedge or guiding profile 232, whipstock mechanical fasteners 240 (e.g., hooks), a packer 238 (e.g., a pull to release packer), a releasable key profile 242, and multiple latch profiles 233, 234, and 236.

The cutter 201 and the mechanical fasteners 203 are movable by the electric motor 221. For example, the electric motor 221 can be attached to a gearbox (not shown) or a similar mechanism that transmits mechanical motion to the cutter 201 and to the mechanical fasteners 203. The electric motor 221 is powered by battery pack 218. The electric motor 221 can be controlled or actuated by the processing device 216. For example, the processing device 216 can include a telemetry system to receive instructions via pressure pulses, and the processing device 216 can actuate the motor 221 to move different components of the sidetrack assembly 105 based on those instructions.

The processing device 216 can include a telemetry system to receive instructions from the surface via pressure pulses. In some implementations, the controller 216 can also include a transducer 209 that transmits and receives information (e.g., with a cable or wirelessly) to and from the surface of the wellbore.

In some implementations, the processing device 216 can be implemented as one or more processors, computers, microcontrollers, or a combination thereof. For example, the processing device 216 can include a telemetry system with sensors and instructions to receive and decode pressure pulses from the surface. The processing device 216 can include one or more processors and a computer-readable medium storing instructions executable by the one or more processors to perform the operations described here. In some implementations, the processing devices 120 and 121 can be implemented as processing circuitry, firmware, software, or combinations of them. The processing device 216 can transmit signals and control the multiple components of the sidetrack assembly 105.

In some implementations, the processing device 216 can receive information from the surface to actuate the motor 221 to begin the cutting process. As further described in detail below with respect to FIGS. 3-9, the processing device 216 can actuate the motor 221 for the motor to move the cutter 201 along a cut profile of the casing to cut and remove a portion of the casing 113.

The cutter 201 includes an arm 204 and a blade 202 rotatably coupled to the arm 204. The arm 204 is attached to a base 224 that allows movement of the arm 204 in a vertical direction or a horizontal direction or both. The processing device 216 is operatively coupled to the arm 204 to move the arm 204. The processing device 216 can move the arm 204 in a predetermined direction to cut a portion of the casing 113 along a predetermined cut profile of the casing 113 to form a window of a predetermined shape and size. The arm 204 moves to blade 202 along the cut profile of the casing 113. When lowering or picking up the cutting tool 104, the blade 202 or the arm 204 or both can be stored in the housing 220 of the cutting tool 104. The arm 204 and the blade 202 can come out from the housing 220 once the motor 221 actuates the arm 204 and the blade 202. The blade 202 can include a circular saw. In some implementations, the cutter can instead or in addition include a different cutter such as a reciprocating saw, a laser cutter, or a torch.

The side arms 222 can also be stored in the housing 220 or a different housing of the cutting tool 104. The side arms 222 can extend (e.g., pivot) away from the body 206 of the cutting tool to position the sidetrack assembly 105 at a desired location with respect to a central longitudinal axis "A" of the wellbore 110. For example, the arms 222 can contact the wall 112 to center the cutting tool 104 along the axis "A" or can help support the cutting tool 104 during the cutting and retrieval process. The arms 222 can be controlled by the electric motor similar to the cutter and the mechanical fasteners.

The power generator 229 can include or be coupled to a turbine 231. The turbine 231 is in fluid communication with the wellbore string 102. The generator 229, together with the turbine 231, converts the hydraulic energy of the drilling fluid to electricity to power the electric motor 221 or charge the power bank 218 or both. For example, the turbine 231 rotates under as the fluid "F" is circulated and the power generator converts mechanical energy of the rotating turbine into electricity. The power generator 229 transmits the electricity to the electric motor 221 or to the power bank 218 or both.

FIGS. 3-9 show sequential steps of cutting a window in the casing and removing the metal cuttings in one trip. FIGS. 3-9 also show the steps of drilling a sidetrack wellbore and retrieving the whipstock assembly from the wellbore 110.

Figure 3:
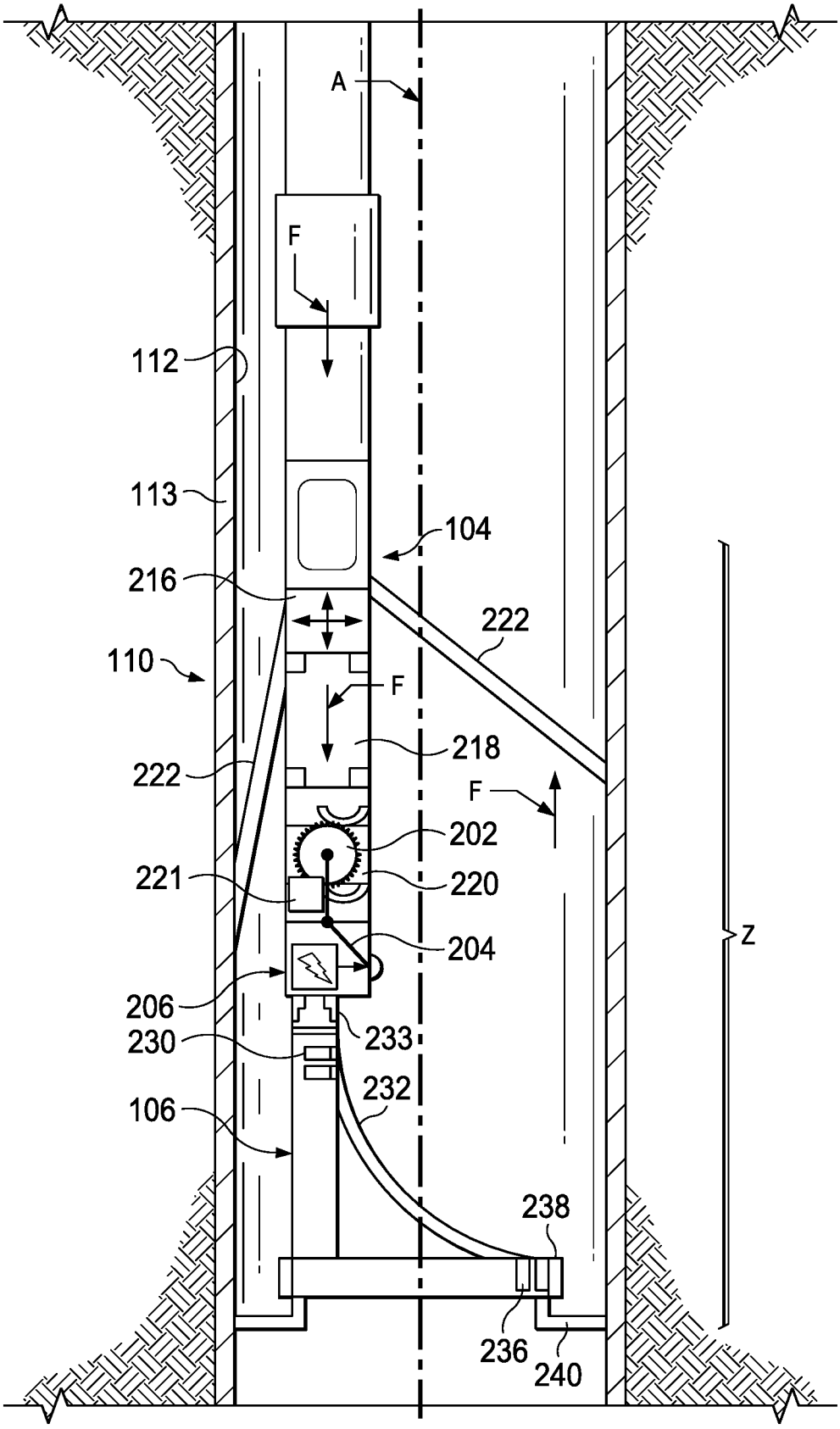
FIGS. 3-9 are front sematic views of sequential steps of a method of drilling a sidetrack wellbore with the sidetracking assembly in FIG. 2.

Referring to FIG. 3, the sidetrack assembly 105 is first lowered to the target zone "Z." The sidetrack assembly 105 can be lowered by lowering the wellbore string 102 automatically or manually from the surface. Once the sidetrack assembly 105 is at the desired depth and location in the wellbore 110, the whipstock 106 is set on the wall 112 of the wellbore 110 at the target zone "Z." The whipstock 106 is set by first actuating the whipstock mechanical fasteners 240 with pressure pulses from the surface, while the packers 238 are deflated or deactivated. For example, the frame 230 of the whipstock 106 can have a bore that flows fluid to an actuator at the base of the frame 230 to actuate the mechanical fasteners 240. The mechanical fasteners 240 can be metal hooks that extend to bite into the casing, or screws with a helix that screws into the casing, or a similar fastener. In some implementations, the mechanical fastener 240 can include slips (or an anchor) with teeth to engage the wall 112.

Before setting the whipstock 106, the wellbore string 102 can circulate drilling fluid "F" as the whipstock assembly is lowered in the wellbore 110. The circulation can be established to ensure that no debris settles on the wellbore wall, presenting complication in whipstock running and setting. Additionally, circulation can be established to ensure clear communication through mud pulses from the surface. The arm 204 and cutter 201 can be inside the housing 220 and the side arms 222 can extend to move the sidetrack assembly 105. For example, the side arms 222 can pivot from the body of the cutting tool 104 to move sidetrack assembly to a desired position offset with respect to the central longitudinal axis "A" of the wellbore 110. Specifically, the side arms 222 can centralize the whipstock 106 such that each hook 240 is spaced a similar distance from the wall 112 of the wellbore 110 before actuating the hooks 240 to set the whipstock 106 on the wall. The side arms 222 can be controlled by the electric motor 221, which is controlled via pressure pulses through the telemetry system of the processing device 216.

Figure 4:
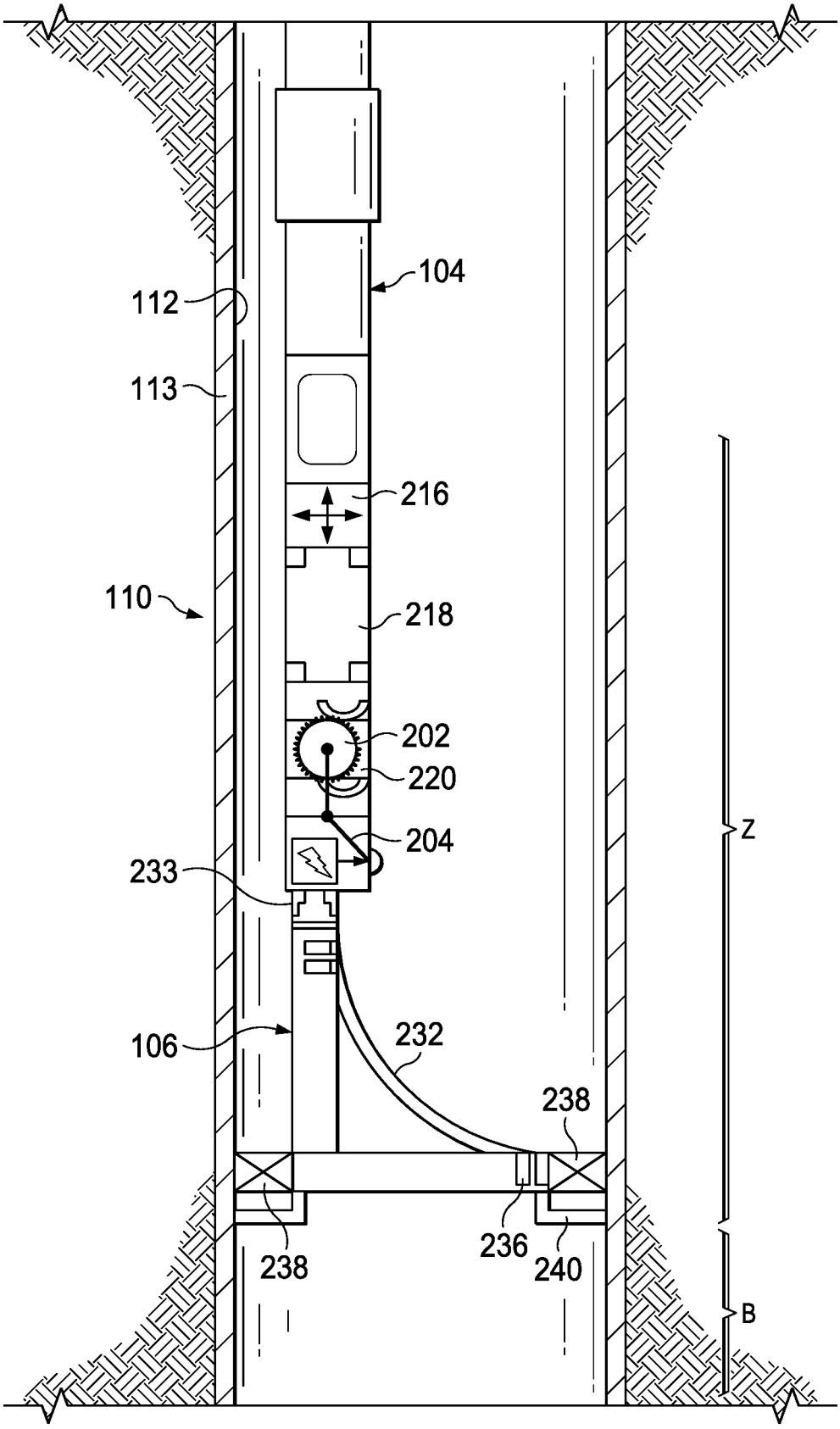

Referring now to FIG. 4, after the whipstock mechanical fasteners 240 are set on the wall of the wellbore 110, the one or more inflatable packers 238 are activated to isolate the target zone "Z" from a section "B" of the wellbore 110 downhole of the whipstock 106. The section "B" can be the section of the wellbore from the whipstock 106 to the bottom hole end of the wellbore 110 or a section of the wellbore 110 from the whipstock 106 to an isolation packer (not shown) disposed downhole of the whipstock 106. For example, the frame 230 of the whipstock 106 can have a bore that flows fluid to the base of the frame 230 to inflate or deploy the inflatable packers 238. Once the packer 238 is set on the wall of the wellbore 110, the side guiding arms 222 can be retracted and a slack-off test and a pressure test can be performed to ensure the packers 238 are set properly.

Figure 5:
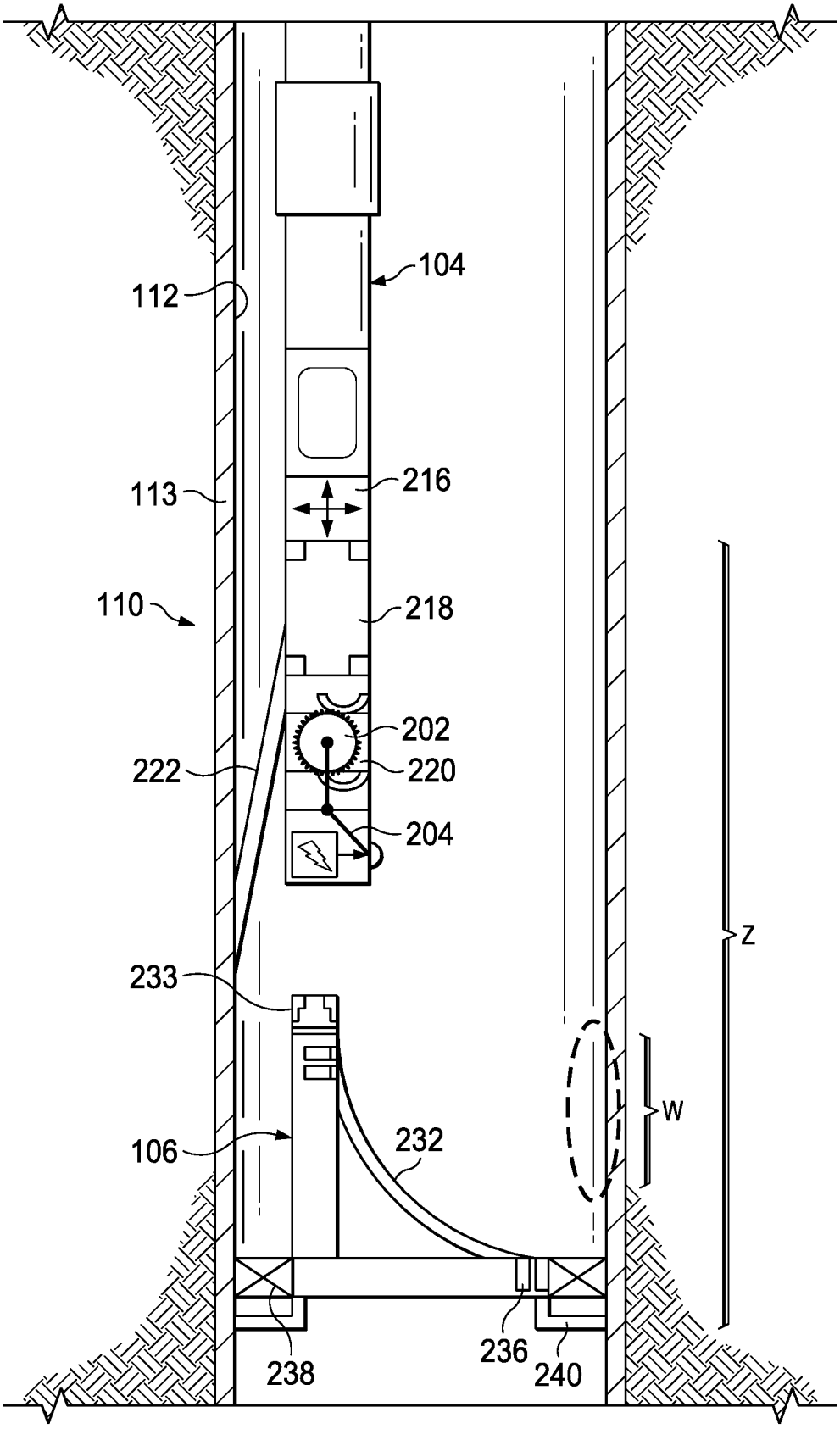
Figure 6:
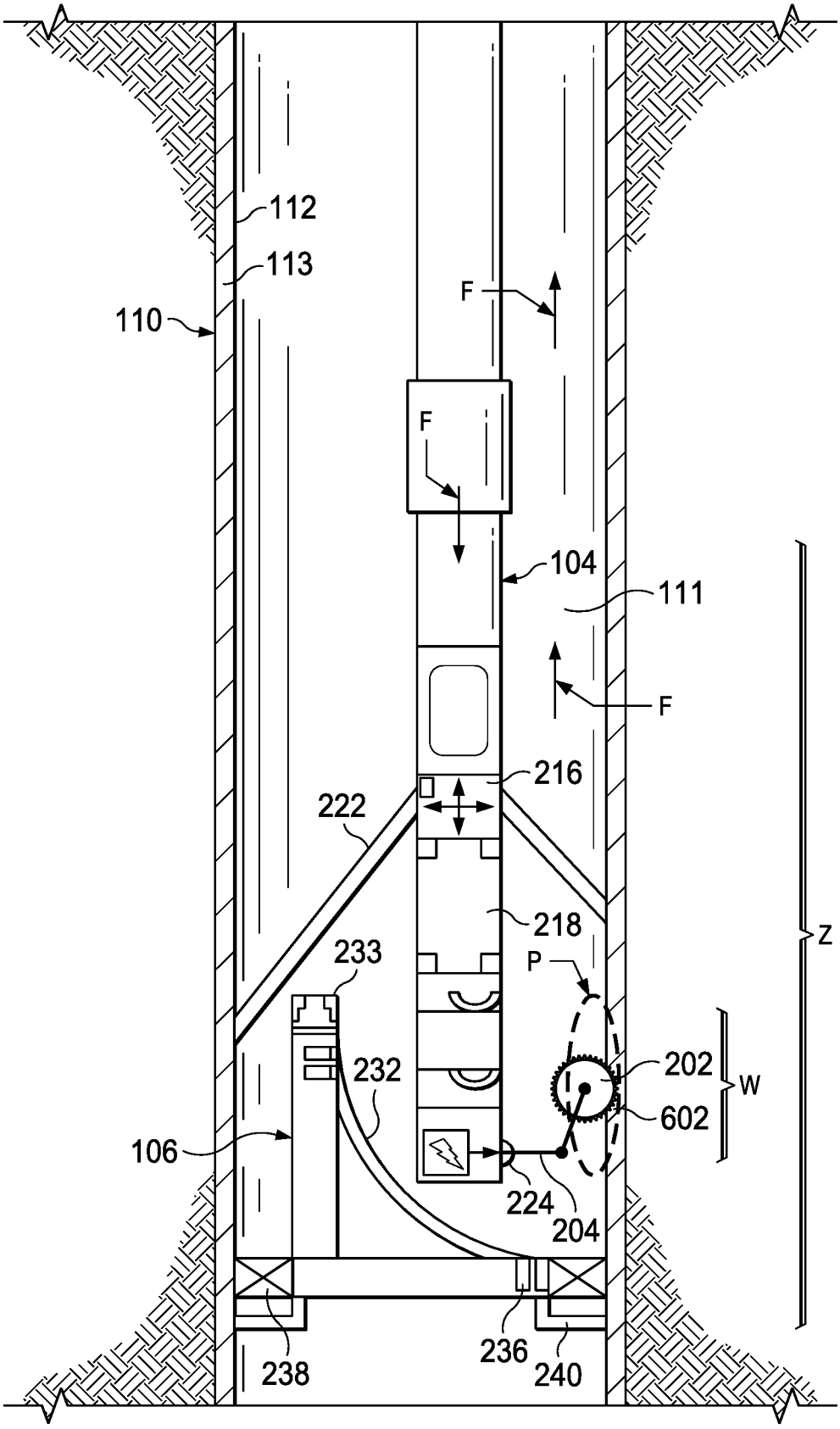

Referring now to FIGS. 5 and 6, with the whipstock 106 set on the well of the wellbore 110, the cutting tool 104 can be pulled up to separate the cutting tool 104 from the whipstock 106. For example, the cutting tool 104 can form a releasable coupling 233 with the whipstock. The releasable coupling 233 can include retracting key profiles, shear-off pins, spring-loaded fasteners, or another kind of releasable coupling. The retracting key profiles can be retracted with pressure pulses from the surface. For example, the retracting key profiles can include a type of spring-loaded plunger that retracts under fluid pressure.

As shown in FIG. 6, the side guiding arms 222 can be reactivated to guide the cutting tool 104 to a window zone or point "W" in the target zone "Z." In some implementations, the window zone or point "W" can be directly above the base of the whipstock 106, where a sidetracking drill bit would be directed by the whipstock 106. Once at the window zone "W," the motor 221 can control the cutter 201 to begin cutting the casing 113. The cutting tool can have sensors to determine when the cutting tool is at the window zone "W" to begin cutting. The motor 221 can actuate and control the cutter 201 to cut the casing 113 along a cut profile "P" of the casing 113 to cut free a portion or cutting 602 of the casing 113 at the target zone "Z." During the cutting, the wellbore string can circulate drilling fluid "F" through the cutting tool 104 and up the annulus 111 to cool the motor 221, the cutter 201, and other components of the cutting tool 104.

The arm 204 and the base 224 can be controlled by the electric motor 221, which is controlled via pressure pulses through the telemetry system of the processing device 216. The base 224 can move the arm along a two-dimensional plane to cut along the cut profile "P" of the casing 113. The arm 204 can be a straight bar or two or more bars attached by a pivotable joint to allow, with one bar pivoting with respect to the other bar, movement of the blade 202 with respect to the casing 113. The depth and location of the window zone "W" and the cut profile "P" can be predetermined automatically or manually (e.g., based on wellbore data). In some implementations, the cutting tool 104 can cut free the portion 602 of the casing 113 with no human interaction.

Figure 7:
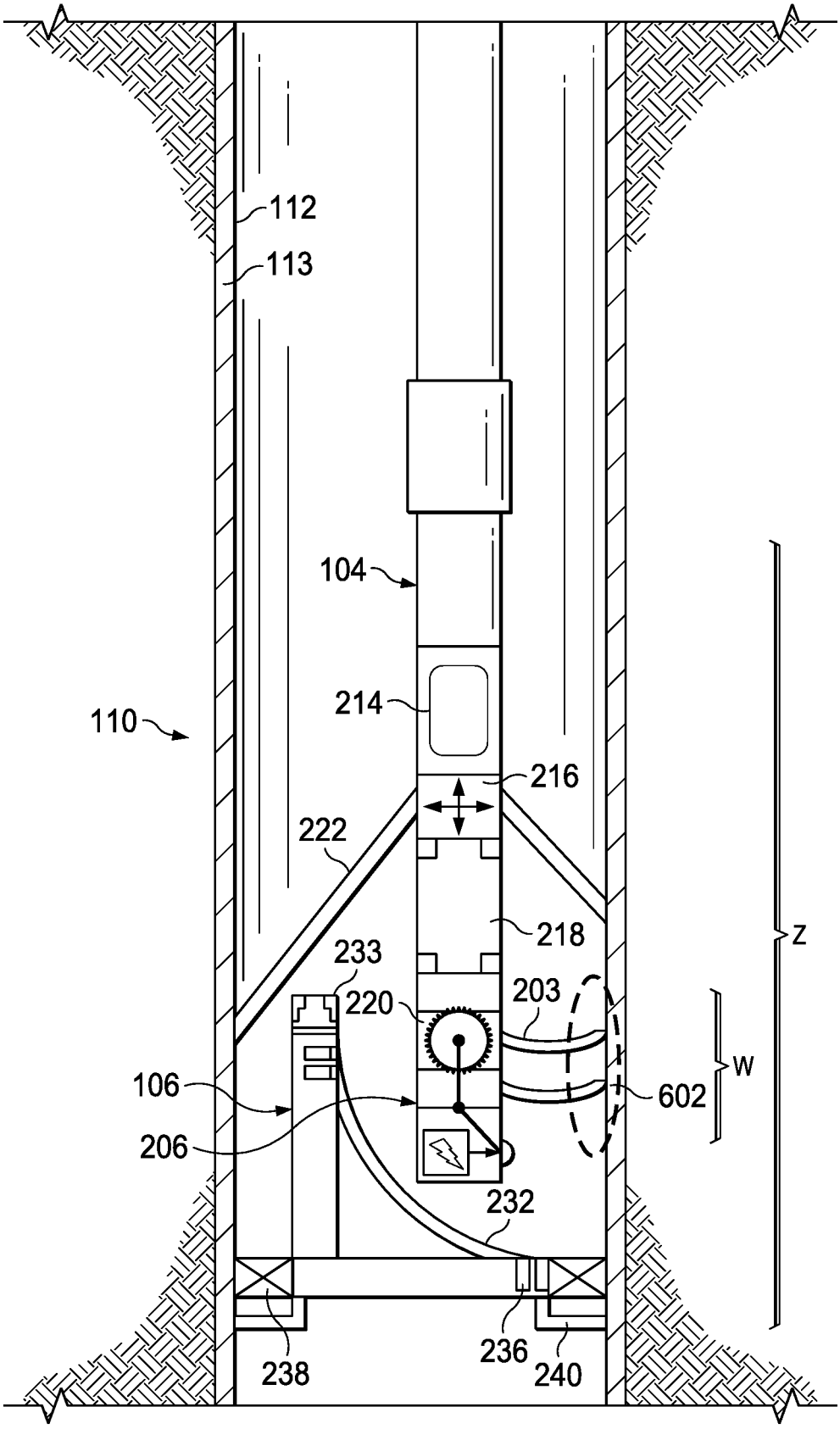

Referring now to FIG. 7, once the cutting operation is performed, the cutter 201 can be returned to the housing 220 to perform the removal operation. During the removal operation, the side arms 222 can position the cutting tool 104 close to the portion 602 of the casing to allow the mechanical fasteners 203 to engage the portion 602 of the casing. The mechanical fasteners 203 can have helix and can be rotated by the motor 221 to screw the mechanical fasteners into the portion 602 of the casing. Similar to the cutter 201, the motor 221 can actuate (e.g., rotate) the mechanical fasteners 203 to engage or fasten the portion 602 of the casing 113 to the cutting tool 104. The side arms 222 can support the cutting tool 104 by pushing the cutting tool 104 toward the casing window zone to allow the mechanical fasteners 203 to engage the casing 113.

With the portion 602 engaged, the sidewise jar 214 can be activated with pressure pulses to remove, with the blows of the sidewise jar 214, the portion 602 from the casing 113 and from the cement behind the casing 113. In other words, the motion of the sidewise jar 214 can loosen or remove the portion 602 of the casing from the cement retaining the portion 602 of the casing to the wall 112 of the wellbore 110 and thus forming a window in the casing 113.

With the portion 602 engaged by the mechanical fasteners 203 and detached from the cement and the casing 113, the cutting tool 104 can be pulled uphole to retrieve the position portion 602 from the wellbore 110. In some implementations, the cutting tool 104 can be pulled uphole to help remove the portion 602 from the cement, detaching the portion 602 from the wall 112 of the wellbore 110 and forming the window in the casing 113.

Figure 8:
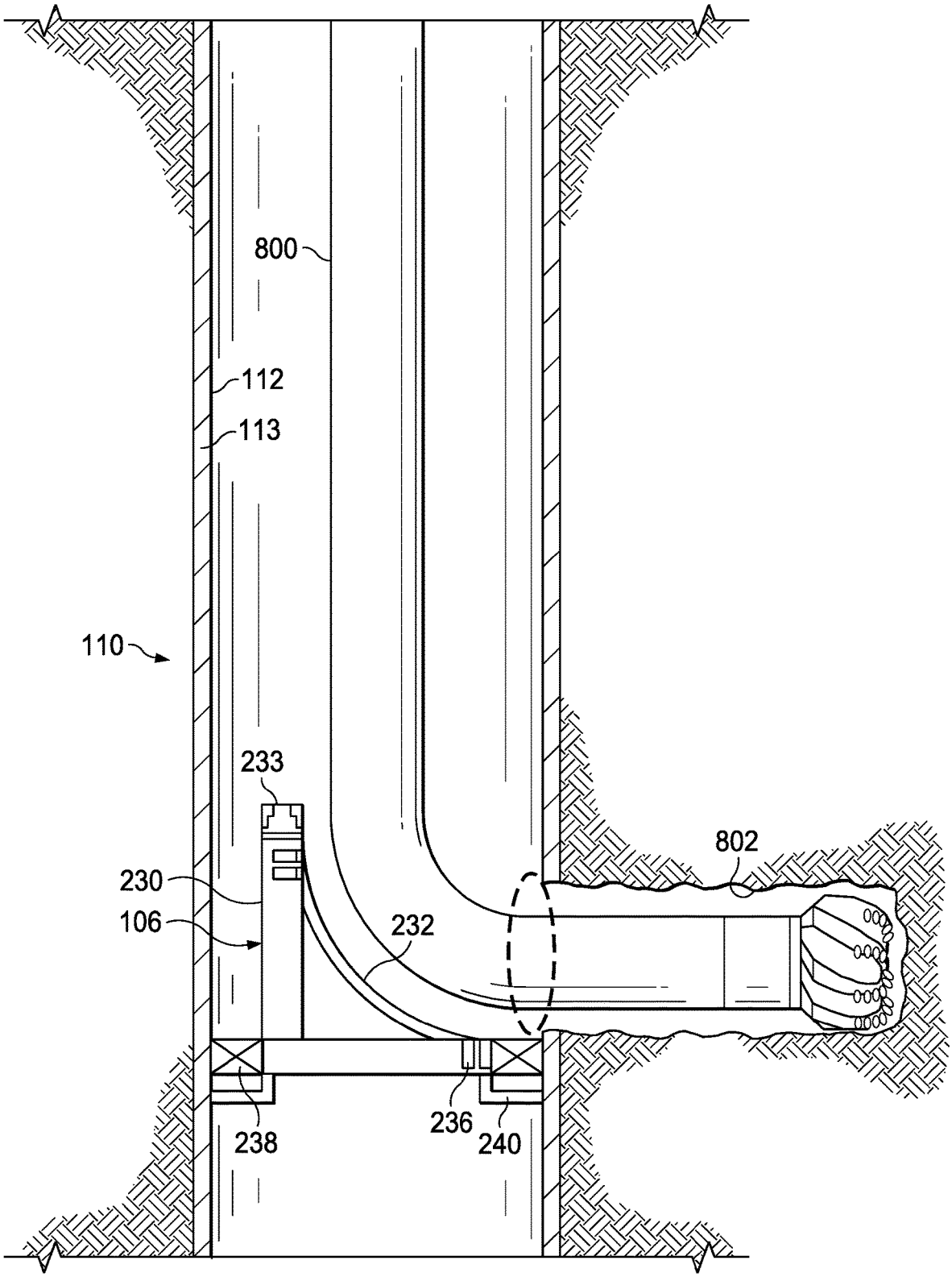

As shown in FIG. 8, with the cutting tool and the portion of the casing removed from the wellbore 110, a directional or sidetrack drill string 800 (e.g., a mill) can be lowered and directed, by the wedge 232 of the whipstock 106, toward the window to begin drilling a sidetrack or branch wellbore 802. The sidetrack wellbore 802 extends from the window to a downhole location of the sidetrack wellbore 802. With the sidetrack wellbore 802 drilled, the sidetrack drill string 800 can be removed from the wellbore 110 to retrieve the whipstock 106.

Figure 9:
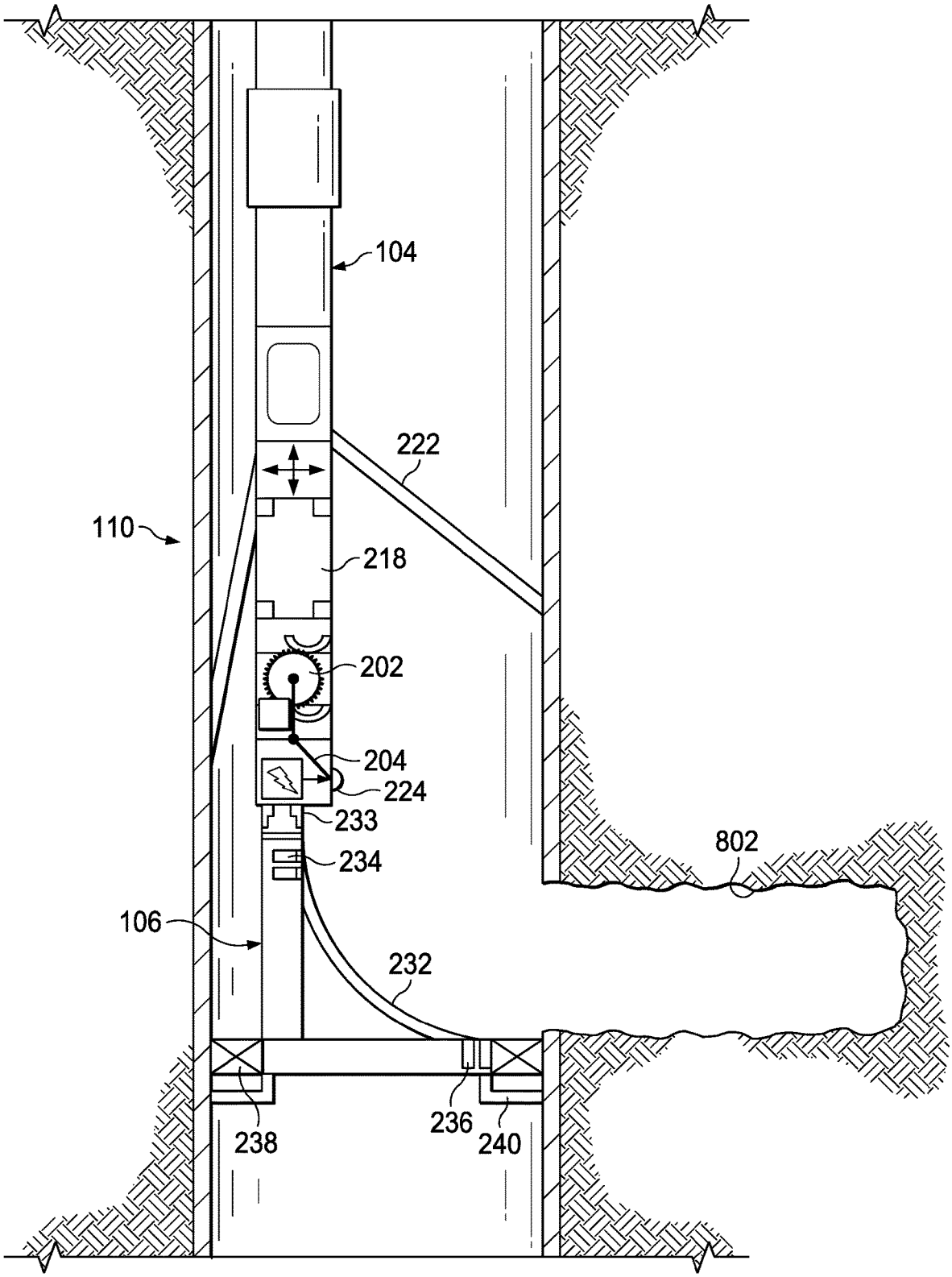

Referring now to FIG. 9, the cutting tool 104 can be lowered in the wellbore 110 to engage the main latch profile 233 of the whipstock 106. The bottom end of the cutting tool 104 can have a corresponding hook or latch to engage the latch profile of 233 of the whipstock 106. To engage the latch profile 233, the side arms 222 can extend to guide the cutting tool 104 toward the latch profile 233. With the whipstock 106 engaged, the wellbore string can be pulled up to remove the whipstock. When the whipstock is pulled up, the pull-to-release packers 238 can deflate and the whipstock mechanical fasteners retract to disengage the wall 112 of the wellbore 110. In some implementations, a different wellbore string (e.g., a dedicated retrieval tool or a fishing tool) can be used to engage and retrieve the whipstock 106.

In case the main latch profile 233 is not able to be engaged, the cutting tool 104 can engage the secondary latching profile 234 or the third latching profile 236 or both. In some implementations, the retrieval tool can latch both the secondary and tertiary retrieval profiles 234 and 236 to pull the whipstock, creating an equal force on both sides of the guide to ensure the deflation of the packer 238.

Referring back to FIG. 2, the cutting tool 104 can be programmed to cut a window of a specified size. Cutting the window with the cutter can eliminate the need of using multiple mills to ensure cutting the window fully and smoothing the edges of the casing at the window, and the need of cleaning or removing the cuttings.

In some implementations, to "cut free" the portion of the casing can refer to cutting the casing such that the portion is free or substantially free from the rest of the casing, although the portion may still be attached to the cement behind the casing.

Figure 10:
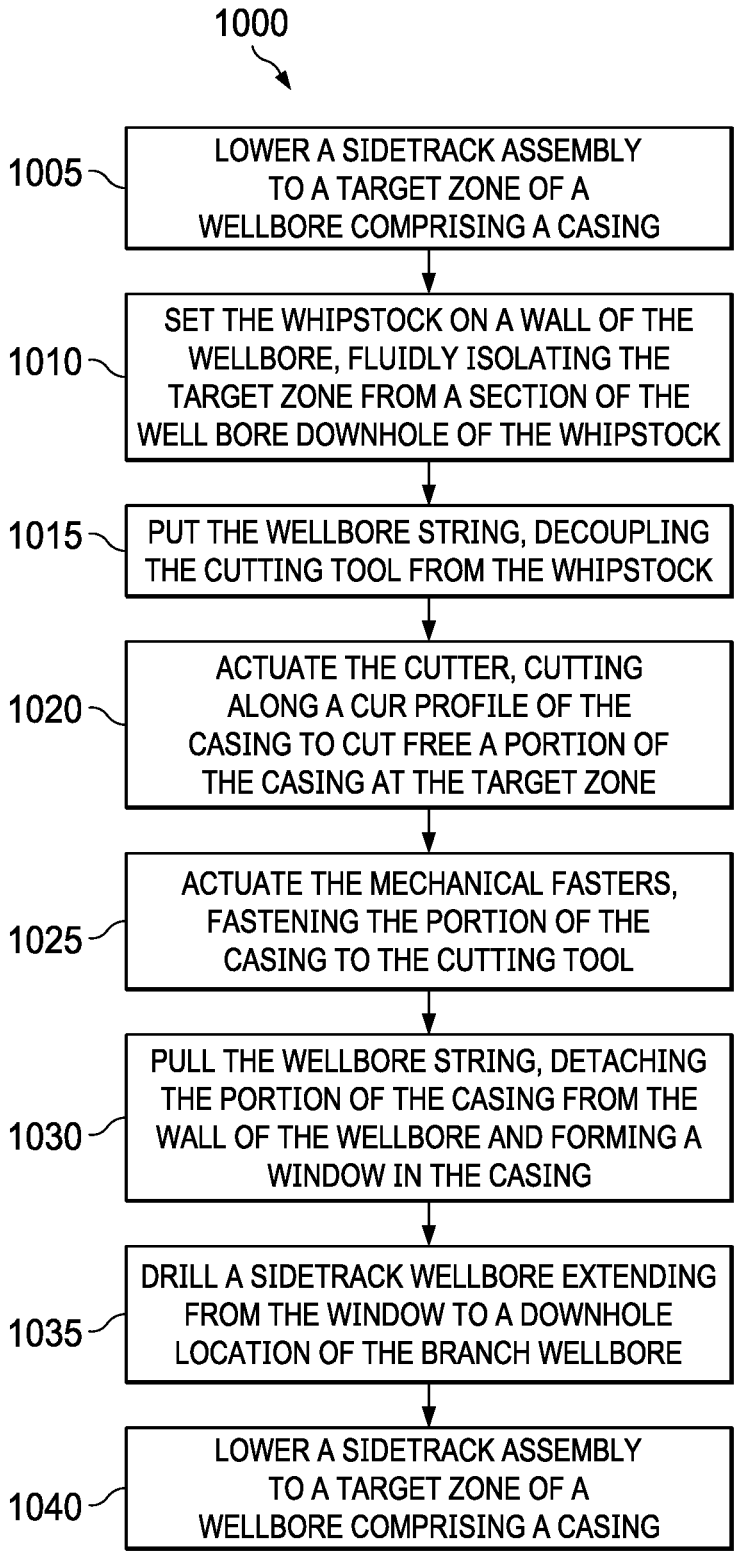
FIG. 10 is a flow chart of method of drilling a sidetrack wellbore.

FIG. 10 shows a flow chart of a method (1000) of drilling a sidetrack wellbore. The method includes lowering a sidetrack assembly to a target zone of a wellbore including a casing, the sidetrack assembly including a cutting tool coupled to a downhole end of a wellbore string and a whipstock releasably coupled to a downhole end of the cutting tool, the cutting tool including a movable cutter and movable mechanical fasteners (1005). The method also includes setting the whipstock on a wall of the wellbore, fluidly isolating the target zone from a section of the wellbore downhole of the whipstock (1010). The method also includes pulling, in an uphole direction, the wellbore string, decoupling the cutting tool from the whipstock (1015). The method also includes actuating the cutter, cutting along a cut profile of the casing to cut free a portion of the casing at the target zone (1020). The method also includes actuating the mechanical fasteners, fastening the portion of the casing to the cutting tool (1025). The method also includes pulling, in an uphole direction, the wellbore string, detaching the portion of the casing from the wall of the wellbore and forming a window in the casing (1030). The method also includes drilling, with a directional drill string guided by the whipstock, a sidetrack wellbore extending from the window to a downhole location of the branch wellbore (1035). The method also includes removing, by the wellbore string or a second wellbore string, the whipstock from the wellbore (1040).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A sidetracking method, comprising:

lowering a sidetrack assembly to a target zone of a wellbore comprising a casing, the sidetrack assembly comprising a cutting tool coupled to a downhole end of a wellbore string and a whipstock releasably coupled to a downhole end of the cutting tool, the cutting tool comprising a movable cutter and movable mechanical fasteners;

setting the whipstock on a wall of the wellbore, fluidly isolating the target zone from a section of the wellbore downhole of the whipstock;

pulling, in an uphole direction, the wellbore string, decoupling the cutting tool from the whipstock;

actuating the cutter, cutting along a cut profile of the casing to cut free a portion of the casing at the target zone, the cutter comprising a rotatable blade coupled to an arm movable by a controller operatively coupled to the arm, the actuating comprising moving, by the controller, the arm to move the blade along the cut profile of the casing;

actuating the mechanical fasteners to fasten, with the mechanical fasteners, the portion of the casing to the cutting tool;

pulling, in an uphole direction and with the mechanical fasteners fastened to the portion of the casing, the wellbore string, detaching the portion of the casing from the wall of the wellbore with the mechanical fasteners and forming a window in the casing;

removing the portion of the casing from the wellbore by pulling the wellbore string and cutting tool out of the wellbore, with the portion of the casing attached to the cutting tool;

drilling, after removing the portion of the casing from the wellbore and with a directional drill string guided by the whipstock, a sidetrack wellbore extending from the window to a downhole location of the sidetrack wellbore; and removing, by the wellbore string or a second wellbore string, the whipstock from the wellbore.

2. The sidetracking method of claim 1, wherein the cutter is operatively coupled to a controller, and actuating the cutting tool comprises actuating, by the controller, the cutter to move the cutter along a cut profile of the casing at the target zone.

3. The sidetracking method of claim 2, wherein the cutting tool comprises one or more arms configured to extend from a body of the cutting tool to the wall of the wellbore, further comprising, before actuating the cutter, actuating the one or more arms to extend the arms from the cutting tool and position the cutting tool at a desired location with respect to a central longitudinal axis of the wellbore.

4. The sidetracking method of claim 1, wherein fluidly isolating the target zone from the downhole location of the wellbore comprises actuating, by pressure pulses through the wellbore string, a packer of the whipstock.

5. The sidetracking method of claim 4, wherein the packer is a pull-to-release inflatable packer and removing the whipstock from the wellbore comprises latching, with the cutting tool, a latch profile of the whipstock and pulling the whipstock uphole, unsetting the pull-to-release inflatable packer from the wall of the wellbore.

6. The sidetracking method of claim 4, wherein the whipstock comprises hooks or anchors configured to engage the wall of the wellbore, and setting the whipstock on the wall of the wellbore comprises actuating, by pressure pulses, the hooks or anchors, setting the whipstock on the wall of the wellbore.

7. The sidetracking method of claim 1, wherein the whipstock is releasably coupled to the cutting tool by at least one retractable key profile activable by pressure pulses, further comprising, before pulling the wellbore string to decouple the cutting tool from the whipstock, activating, by pressure pulses, the key profile, retracting the key profile and disengaging the cutting tool from the whipstock.

8. A sidetracking method, comprising:

lowering a sidetrack assembly to a target zone of a wellbore comprising a casing, the sidetrack assembly comprising a cutting tool coupled to a downhole end of a wellbore string and a whipstock releasably coupled to a downhole end of the cutting tool, the cutting tool comprising a movable cutter and movable mechanical fasteners;

setting the whipstock on a wall of the wellbore, fluidly isolating the target zone from a section of the wellbore downhole of the whipstock;

pulling, in an uphole direction, the wellbore string, decoupling the cutting tool from the whipstock;

actuating the cutter, cutting along a cut profile of the casing to cut free a portion of the casing at the target zone;

actuating the mechanical fasteners, fastening the portion of the casing to the cutting tool;

pulling, in an uphole direction, the wellbore string, detaching the portion of the casing from the wall of the wellbore and forming a window in the casing; and drilling, with a directional drill string guided by the whipstock, a sidetrack wellbore extending from the window to a downhole location of the sidetrack wellbore; and removing, by the wellbore string or a second wellbore string, the whipstock from the wellbore;

wherein the cutting tool comprises an electric motor configured to move the cutter and the mechanical fasteners, the cutting tool comprising a turbine coupled to a power generator, the turbine in fluid communication with the wellbore string and configured to rotate under fluidic pressure, the power generator configured to transmit, to the electric motor or to a battery pack configured to power the electric motor, electricity generated by rotation of the turbine to power the motor.

9. A sidetracking method, comprising:

lowering a sidetrack assembly to a target zone of a wellbore comprising a casing, the sidetrack assembly comprising a cutting tool coupled to a downhole end of a wellbore string and a whipstock releasably coupled to a downhole end of the cutting tool, the cutting tool comprising a movable cutter and movable mechanical fasteners;

setting the whipstock on a wall of the wellbore, fluidly isolating the target zone from a section of the wellbore downhole of the whipstock;

pulling, in an uphole direction, the wellbore string, decoupling the cutting tool from the whipstock;

actuating the cutter, cutting along a cut profile of the casing to cut free a portion of the casing at the target zone;

actuating the mechanical fasteners, fastening the portion of the casing to the cutting tool;

pulling, in an uphole direction, the wellbore string, detaching the portion of the casing from the wall of the wellbore and forming a window in the casing; and drilling, with a directional drill string guided by the whipstock, a sidetrack wellbore extending from the window to a downhole location of the sidetrack wellbore; and removing, by the wellbore string or a second wellbore string, the whipstock from the wellbore;

wherein the sidetrack assembly further comprises a jar assembly, further comprising, before pulling the wellbore string to detach the portion of the casing from the wall of the wellbore, actuating, by pressure pulses, the jar assembly to loosen or remove the portion of the casing from cement retaining the portion of the casing to the wall of the wellbore.

10. The sidetracking method of claim 1, wherein cutting the portion of the casing comprises circulating, in the wellbore, drilling fluid, cooling the cutting tool.

11. The sidetracking method of claim 1, wherein the sidetrack assembly comprises a bottom hole assembly (BHA) fluidly coupled to the wellbore string.

12. A method, comprising:

positioning a cutting tool at a target zone of a wellbore comprising a casing, the cutting tool coupled to a downhole end of the a wellbore string extending from a terranean surface of the wellbore, the cutting tool comprising mechanical fasteners movable by the cutting tool;

actuating the cutting tool, cutting free a portion of the casing at the target zone, the cutting tool comprising a rotatable blade coupled to an arm movable by a controller operatively coupled to the arm, the actuating comprising moving, by the controller, the arm to move the blade along a cut profile of the casing;

actuating the mechanical fasteners, fastening the portion of the casing to the cutting tool;

moving, with the mechanical fasteners fastened to the portion of the casing, the wellbore string, removing the portion of the casing from the casing with the mechanical fasteners and forming a window in the casing; and removing the portion of the casing from the wellbore by pulling the cutting tool out of the wellbore, with the portion of the casing attached to the cutting tool to allow the drilling of a sidetrack wellbore extending from the window to a downhole location of the sidetrack wellbore.

13. A method, comprising:

positioning a cutting tool at a target zone of a wellbore comprising a casing, the cutting tool coupled to a downhole end of the a wellbore string extending from a terranean surface of the wellbore, the cutting tool comprising mechanical fasteners movable by the cutting tool;

actuating the cutting tool, cutting free a portion of the casing at the target zone;

actuating the mechanical fasteners, fastening the portion of the casing to the cutting tool; and pulling the wellbore string uphole, removing the portion of the casing from the casing and forming a window in the casing;

wherein the cutting tool is operatively coupled to a controller, and actuating the cutting tool comprises actuating, by the controller, an arm attached to a rotatable blade of the cutting tool to move the blade along a cut profile of the casing at the target zone.

14. The method of claim 13, wherein the cutting tool comprises an electric motor operatively coupled to the rotatable blade and to the mechanical fasteners and actuating the cutting tool comprises actuating, by the controller, the electric motor to move the blade along a cut profile, actuating the mechanical fasteners comprises actuating, by the controller, the electric motor to screw the mechanical fasteners into the portion of the casing.

15. The method of claim 14, wherein the cutting tool further comprises a jar assembly, further comprising, before pulling the wellbore string to remove the portion of the casing from the casing, actuating, by pressure pulses, the jar assembly to loosen or remove the portion of the casing from cement retaining the portion of the casing to a wall of the wellbore.

16. A wellbore assembly comprising:

a wellbore string configured to be disposed within a wellbore comprising a casing; and a sidetrack assembly fluidly coupled to the wellbore string, the sidetrack assembly comprising:

a cutting tool coupled to a downhole end of a wellbore string, the cutting tool comprising a movable cutter and movable mechanical fasteners, the cutting tool configured to move the movable cutter along a cut profile of the casing to cut a portion of the casing, the cutting tool configured to move the movable mechanical fasteners to engage the portion of the casing and remove, with the mechanical fasteners fastened to the portion of the casing, the portion of the casing from a wall of the wellbore and form a window by pulling the cutting tool out of the wellbore with the portion of the casing attached to the mechanical fasteners, and a whipstock assembly releasably coupled to a downhole end of the cutting tool, the whipstock assembly comprising at least one packer configured to fluidly isolate the cutting tool from a section of the wellbore downhole of the whipstock;

wherein the cutter comprises a rotatable blade coupled to an arm movable by a controller operatively coupled to the arm, the controller configured to move the arm to move the blade along the cut profile of the casing.

17. The wellbore assembly of claim 16, wherein the whipstock is configured to be set downhole of the portion of the casing and comprises a wedge to guide, with the whipstock set on a wall of the wellbore, a drill string toward the window such that the dill string drills a sidetrack wellbore extending from the window to a downhole location of the sidetrack wellbore.

18. The wellbore assembly of claim 16, wherein the packer is a pull-to-release packer, the pull-to-release packer activable by pressure pulses.

19. The wellbore assembly of claim 16, wherein the cutting tool further comprises one or more arms configured to extend from a body of the cutting tool, contacting the wall of the wellbore to center the cutting tool or position the cutting tool at a desired location with respect to a central longitudinal axis of the wellbore.

* * * * *